United States Patent [19]

MacDonald

[11] 4,129,199

[45] Dec. 12, 1978

[54] ELEVATOR SYSTEM

[75] Inventor: Robert C. MacDonald, West Caldwell, N.J.

[73] Assignee: Westinghouse Electric Corp., Pittsburgh, Pa.

[21] Appl. No.: 792,289

[22] Filed: Apr. 29, 1977

[51] Int. Cl.[2] ..... B66B 1/20

[52] U.S. Cl. ..... 187/29 R

[58] Field of Search ..... 187/29

[56] References Cited

U.S. PATENT DOCUMENTS

| | | | |
|---|---|---|---|
| 3,895,692 | 7/1975 | Yeasting | 187/29 |
| 4,037,688 | 7/1977 | Winkler | 187/29 |
| 4,047,596 | 9/1977 | Winkler | 187/29 |

*Primary Examiner*—Robert K. Schaefer
*Assistant Examiner*—W. E. Duncanson, Jr.
*Attorney, Agent, or Firm*—D. R. Lackey

[57] ABSTRACT

An elevator system, and method of operating same, which includes a plurality of elevator cars mounted in a building to serve the floors therein. The building includes a special floor, located between the top and bottom floors, from which all calls for elevator service in the up and down directions may be registered. Supervisory control apparatus, which assigns a hall call to a selected elevator car, gives priority to a predetermined service direction from the special floor when hall calls for both the up and down directions coexist therefrom, with the priority direction being responsive to the position of the special floor in the building.

10 Claims, 6 Drawing Figures

FIG. 1

FIG.1
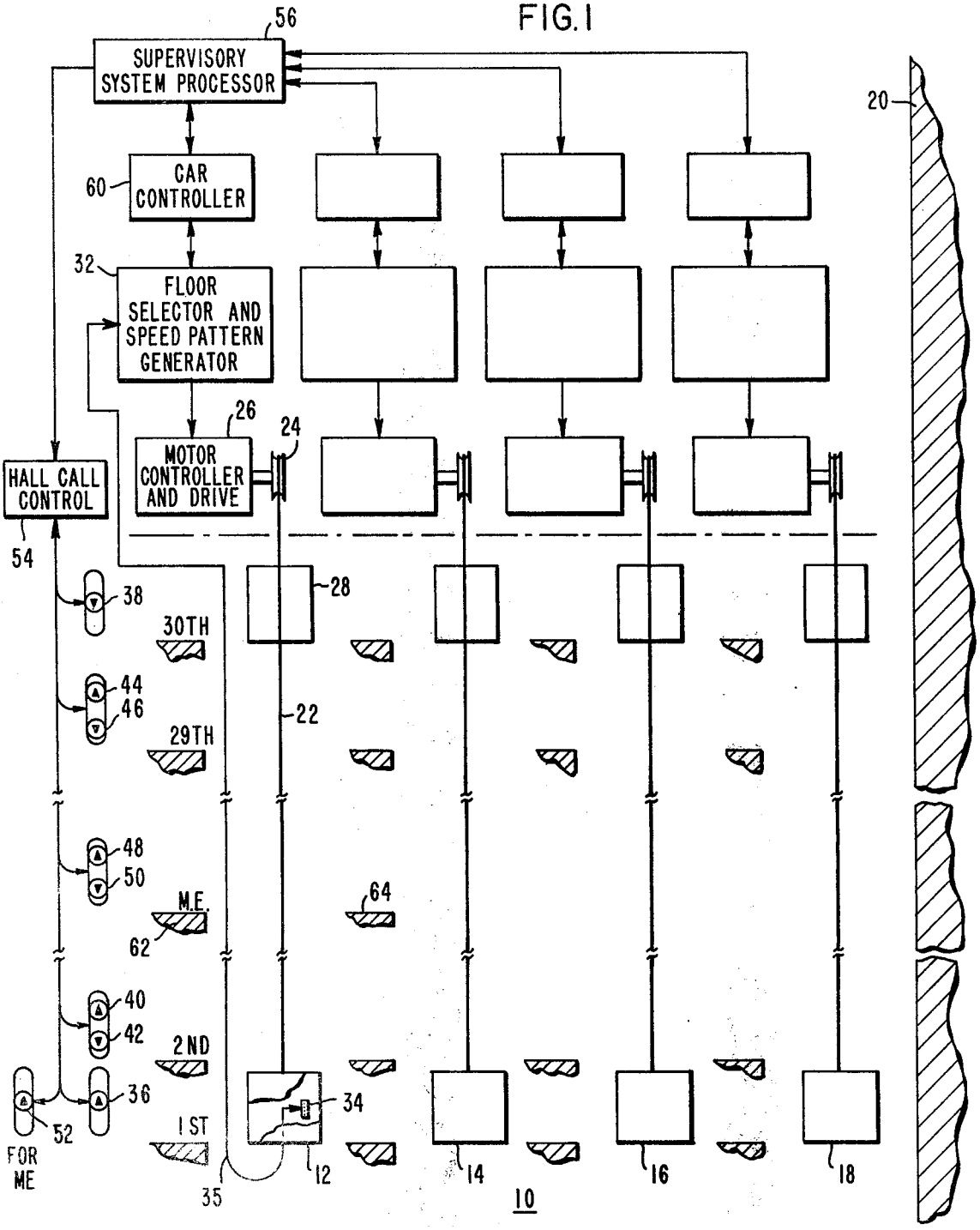
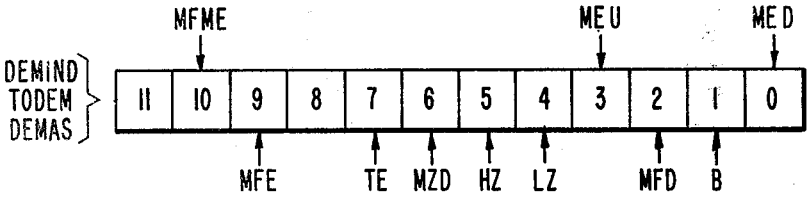
FIG.5

ELEVATOR SYSTEM

BACKGROUND OF THE INVENTION

1. Field of the Invention

The invention relates in general to elevator systems, and more specifically to new and improved elevator supervisory control apparatus for directing a plurality of elevator cars to more efficiently serve the floors of a building.

2. Description of the Prior Art

Elevator systems which include a plurality of elevator cars, and supervisory control for directing the elevator cars to serve registered hall or floor calls according to a predetermined strategy, usually have special strategies for serving calls which originate from basement and top extension floors. A building may also have one or more special floors, other than the main floor, basement floors, and top extension floors, which are to be provided with special service for some reason. The special service may be necessary, for example, because this floor is served by fewer than the total number of elevator cars, such as by only one or two of the cars out of a bank of elevator cars. Since mid-extensions are normally served by less than the total number of elevator cars in a bank, such a floor is often referred to as a mid-extension floor.

When a hall call for elevator service is registered from this special floor, or specifically for this floor by a special button located remotely from this floor, the search for an in-service idle car capable of serving this floor should be given a fairly high priority over other demands for elevator service. This insures that when a car capable of serving this special floor becomes available for assignment, that it will be assigned to the special floor demand, rather than to demands which other elevator cars could also handle.

A floor may also be selected for special service, even when it is served by all of the elevator cars, in order to provide a higher priority for the demands related to this floor, than to demands from other intermediate floors in the building.

Since service for such special floors requires a special strategy, the special strategy should be selected such that it has as little adverse affect on the over-all quality of elevator service to the building as possible.

SUMMARY OF THE INVENTION

Briefly, the present invention is a new and improved elevator system for a building having a plurality of elevator cars, in which a floor intermediate the top and bottom floors is to be provided with special service. The present invention recognizes that elevator service to the building as a whole may be improved by detecting when hall calls for both the up and down service directions coexist from the special floor, and then give a predetermined one of the hall calls priority over the other, depending upon the location of the special floor in the building. When the special floor is located in the lower one-half of the building, a down hall call at the special floor is given priority over a coexisting up hall call at the special floor. When the special floor is in the upper one-half of the building, the up hall call is given priority.

The strategy of the present invention is especially important in modern solid-state elevator control systems having a programmable supervisory control system. In such systems, the number of elevator cars enabled to serve any selected floor may be easily changed, and thus the location of the special floor may not be a static selection, but subject to change according to changing building usage. Also, in such systems, a special floor may be selected by an address instruction stored in the memory of the system processor, and the location of the special floor may be changed by merely changing the address. Such a change may even be accomplished automatically, such as by a clock, or in response to predetermined traffic conditions. The present invention automatically accounts for the location of the special floor in the building, providing priority service for the special floor while creating minimal adverse affect on the over-all quality of elevator service to the rest of the building.

BRIEF DESCRIPTION OF THE DRAWINGS

The invention may be better understood, and further advantages and uses thereof more readily apparent, when considered in view of the following detailed description of exemplary embodiments, taken with the accompanying drawings in which:

FIG. 1 is a diagrammatic view of an elevator system having a special floor, which may benefit by utilizing the teachings of the invention;

FIG. 5 is a diagrammatic representation of system processor words established in the memory of a programmable system processor, to keep track of system demands, the type of demands, and whether an elevator car has been assigned to certain of the demands.

DESCRIPTION OF PREFERRED EMBODIMENTS

Figure 4:
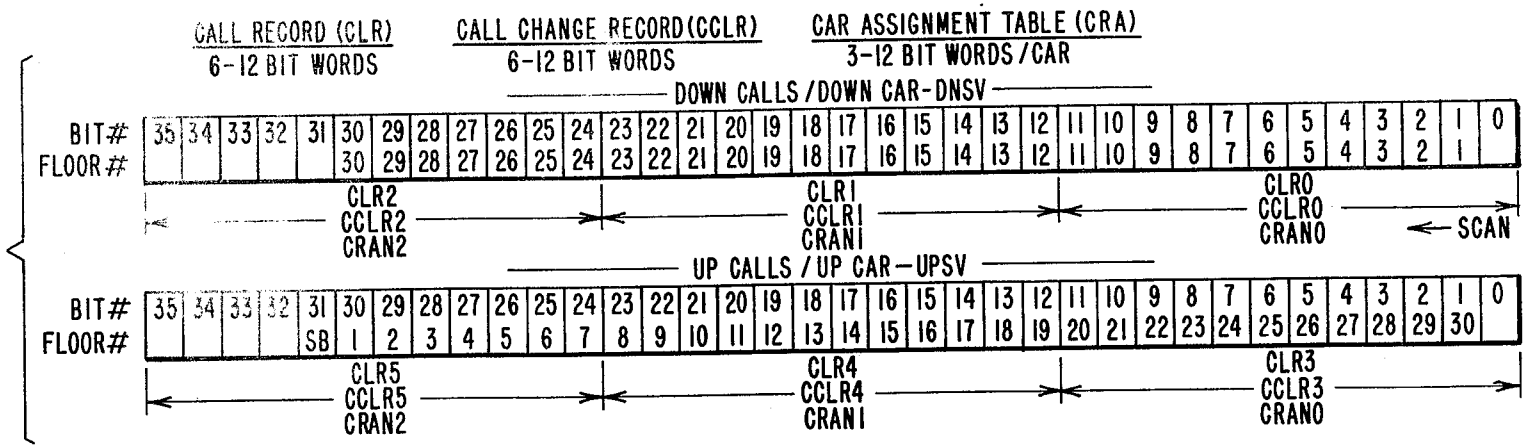
FIG. 4 is a diagrammatic representation of a call record, call change record, and a car assignment table, which may be used in an elevator system constructed according to the teachings of the invention.

Referring now to the drawings, and to FIG. 1 in particular, there is shown a diagrammatic view of an elevator system 10 which may benefit from the teachings of the invention. In order to illustrate only those parts of an elevator system which are directly involved in the present invention, it will be assumed that the elevator system is that system shown in the following U.S. patents, all of which are assigned to the same assignee as the present application. These patents are hereby incorporated by reference.

(1) U.S. Pat. No. 3,750,850 — "Floor Selector for an Elevator Car"

(2) U.S. Pat. No. 3,804,209 — "Elevator System"

(3) U.S. Pat. No. 3,851,733 — "Elevator System"

U.S. Pat. No. 3,750,850 discloses a floor selector for operating an elevator car. U.S. Pat. No. 3,804,209 discloses a supervisory system processor for directing the activities of a bank of elevator cars, as well as illustrating modifications to the floor selector of U.S. Pat. No. 3,750,850, which are necessary to enable a plurality of elevator cars to operate under group control. U.S. Pat. No. 3,851,733 discloses strategy for directing a plurality of elevator cars to efficiently serve calls for elevator service, which strategy may be utilized by the supervisory system processor of U.S. Pat. No. 3,804,209.

More specifically, elevator system 10 includes a plurality of elevator cars 12, 14, 16 and 18 of the traction type, each mounted for movement in a building 20 to serve the floors therein. Since each of the elevator cars and its related apparatus are similar, only elevator car 12 and its associated apparatus will be described in detail.

The building 20 may have any number of floors, such as 30, with only the 1st, 2nd, 29th, 30th, and a special floor reference M.E., being shown in order to simplify the drawing. Elevator car 12 is supported by a plurality of wire ropes, shown generally at 22, which are reeved over a traction sheave 24 mounted on the shaft of a suitable drive machine, shown generally at 26 as a combination motor controller and drive. For example, the drive machine may include a direct current drive motor and solid state control for providing the desired magnitude of direct current voltage. U.S. Pat. Nos. 3,713,011 and 3,713,012, which are assigned to the same assignee as the present application, describe such a solid state drive system in detail. A counterweight 28 is connected to the other ends of ropes 22.

A floor selector and speed pattern generator, shown generally at 32, controls elevator car 12. The floor selector keeps track of the position of the elevator car 12 in the hoistway and the calls for elevator service. The floor selector controls the speed pattern generator which in turn provides signals for operating the motor controller and drive 26.

Car calls, registered in elevator car 12, such as on pushbutton array 34, are directed to the floor selector 32 via a traveling cable 35. Up and down hall calls, registered by prospective passengers on pushbuttons mounted in the hallways, such as up pushbutton 36 at the first floor, down pushbutton 38 at the 30th floor, and up and down pushbuttons at each of the intermediate floors, such as up and down pushbuttons 40 and 42, respectively, at the second floor, and up and down pushbuttons 44 and 46, respectively, at the 29th floor.

A special intermediate floor, referenced M.E. for "middle extension," also includes up and down pushbuttons 48 and 50, respectively. A special up pushbutton 52 is located at the main floor for placing a hall call for the middle extension floor M.E.

The hall calls are directed to suitable hall call control 54, and hall call control 54 sends the hall calls to a supervisory system processor 56.

The supervisory system processor 56 prepares assignments for the various elevator cars in response to hall calls and the car status information received from each of the cars, and sends the assignments to the car controllers of each of the cars, such as car controller 60 for elevator car 12. Car controller 60 sends appropriate signals to the floor selector and speed pattern generator 32.

The special floor M.E., which is located between the uppermost and lowermost floors of the building, may be a special floor for any number of reasons. For purposes of example, it will be assumed that floor M.E. is special because fewer than the total number of elevator cars are enabled to serve this floor, i.e., only elevator cars 12 and 14 are able to serve this floor. This is indicated in FIG. 1 by illustrating fragmentary portions 62 and 64 of a floor adjacent to the M.E. floor for elevator cars 12 and 14, while omitting such indications of a floor adjacent the M.E. floor for cars 16 and 18. There may be no opening through the hoistway wall at the M.E. floor for elevator cars 16 and 18, or, if there are openings, cars 16 and 18 may be inhibited from serving this floor. The inhibit situation may be permanent, i.e., not easily changed without extensive modification of the various controls, or it may be temporary, i.e., easily changed to either eliminate the special floor feature, or to move the special floor feature to any other selected floor between the top and bottom floor. While the invention is illustrated and described relative to a single special floor, it is to be understood that the methods and apparatus disclosed herein are equally suitable for servicing a plurality of special floors.

Figure 2:
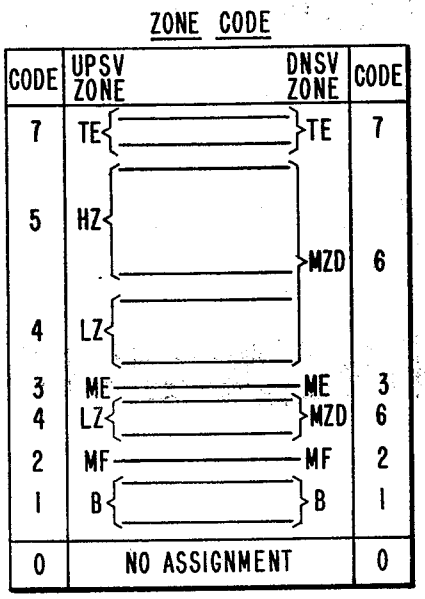
FIGS. 2 and 3 illustrate different locations of a special floor in a building, which locations result in different hall call strategies, according to the teachings of the invention.
Figure 3:
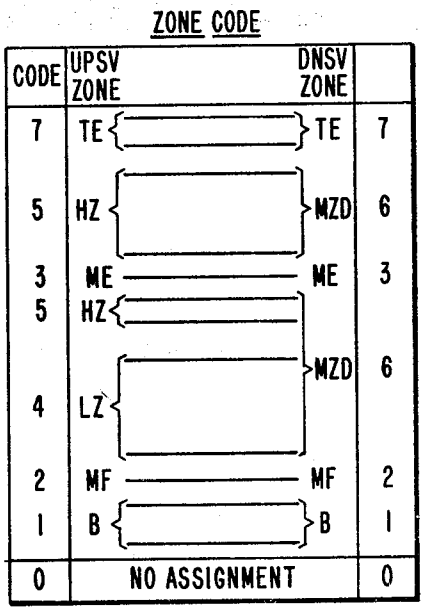

FIGS. 2 and 3 illustrate how the building 20 may be zoned and coded, for two different locations of the special floor M.E. Except for the addition of the special floor, the zone code shown in FIGS. 2 and 3 is similar to the zone code shown in FIG. 15 of incorporated U.S. Pat. No. 3,851,733. In FIG. 2, the special floor is located in the lower one-half of the building 20, and as such, it divides the up-service zone LZ into two parts, and the main down-service zone MZD into two parts. The special floor M.E. is given the code 3 for both up and down service. In FIG. 3, the special floor is located in the upper one-half of the building 20, and as such, it divides the high up service zone HZ into two parts, as well as dividing the main down service zone MZD into two parts. The special floor M.E. retains zone code No. 3 regardless of its position in the building.

FIG. 4 of the present application is the same as FIG. 7 of the incorporated U.S. Pat. No. 3,851,733. FIG. 4 illustrates the call record CLR, the call change record CCLR, and car assignment table CRA. These records each use different memory locations in the system processor 56 shown in FIG. 1, but they are illustrated in a consolidated manner in FIG. 4 for convenience.

When hall call control 54 provides information as to registered hall calls, the information is stored in a memory location which includes six 12-bit words for a building having up to 36 floors. This is the call record CLR, with the calls being stored therein on a one bit per floor per direction basis. Words CLR0, CLR1, and CLR2 provide 36 bits and thus room for storing down calls from 36 floors. Words CLR3, CLR4, and CLR5 provide 36 bits and room for storing up calls from 36 floors. Thus, if the special floor M.E. is floor No. 10, bit 10 of word CLR0 would be checked to see if a down hall call has been registered from the special floor, and bit 21 of word CLR4 would be checked to see if an up hall call has been registered from the special floor. The special button 52 at the first floor is assigned bit No. 31 of word CLR5, and this bit would be checked to see if there is a call for the special floor from the first floor or main floor of the building.

The call change record CCLR follows the same format as the call record CLR, and its six words are in the same region of the magnetic core. The latest call record is compared with the immediately preceding one, and a bit is set in the call change record for each change. Thus, a new up or down hall call will set a bit in the call change record, since a set bit appears for this floor in the latest reading of the hall call control but not in the previous reading. In like manner, a reset hall call, i.e., one that has been answered, will set a bit in the call change record since a set bit appears for the associated floor in the previous record but not in the latest reading.

Car assignment table CRA contains three words per car for a building having up to 36 floors, with the convention used for up service cars (UPSV) and down service cars (DNSV) being the same as used for the storage of up and down hall calls, respectively, in the call record CLR. The specific convention used is determined by the service direction of the car. Thus, when the service direction of a car is down, the three words CRAN0 through CRAN2 of its assignment table will have the convention of the upper table in FIG. 4. When the service direction is up, its three words CRAN0-CRAN2 will have the convention of the lower table in FIG. 4. When a program allocates a call to a car, or assigns a car to a specific floor, it sets an indicator or bit for the floor in question in the car's assignment table CRA.

In the strategy of U.S. Pat. No. 3,851,733, the system processor 56 attempts to allocate a hall call to a suitably conditioned busy car, i.e., an elevator car which is already busy with the task of serving a call, or calls, for elevator service, having a service direction which is compatible with the call. Failing to so allocate a hall call, a "demand" signal is created relative to this hall call. Demands are satisfied by locating an "available" car, i.e., an in-service car which is not already busy serving a call for elevator service, and assigning the available car to serve the demand. The associated control of an elevator car provides a signal AVAS for the system processor when it is "available," which by definition in the incorporated patent is an elevator car which is in-service, an elevator car which is not running or decelerating, and an elevator car which is parked with its doors closed.

When there is a demand for an available car and there is at least one available car, the system processor successively checks the different types of system demands, in a predetermined order of priority. The different types of system demands are indicated in FIG. 5, which figure is similar to FIG. 10 of the incorporated U.S. Pat. No. 3,851,733. FIG. 5 illustrates data words DEMIND, TODEM, and DEMAS. Where DEMIND is a demand indicator word, with bits of the word being assigned to different types of service demands. For example, a main floor demand for service to a top extension floor (MFE) is assigned to bit 9, a top extension floor demand (TE) is assigned to bit 7, a main zone down demand (MZD) is assigned to bit 6, a high zone up demand (HZ) is assigned to bit 5, a low zone up demand (LZ) is assigned to bit 4, a main floor demand (MF) is assigned to bit 2, and a basement demand (B) is assigned to bit 1. An up call at the special floor M.E. which cannot be allocated to a suitably conditioned busy elevator car capable of serving this floor, sets bit No. 3 of word DEMIND, as illustrated with M.E.U. to indicate a middle extension up call. A down call at the special floor M.E. which cannot be allocated to a suitably conditioned busy car capable of serving this floor may either set the same bit No. 3 of DEMIND, which would require that the call record CLR of FIG. 4 be checked when bit No. 3 is set to see if an up call, down call, or both, caused the demand bit to be set; or, the unallocated down call may set another bit of the word DEMIND, such as bit 0, illustrated in FIG. 5 with the letters M.E.D. to indicate a middle extension down hall call.

An up call from the main floor for the special floor M.E. which cannot be allocated to a suitably conditioned busy car sets bit No. 10 of the word DEMIND in FIG. 5. A system demand, thus sets a bit in the word DEMIND, with the bit being set corresponding to the type of demand registered.

Word TODEM is used for timed out demands, and this word uses the same convention as DEMIND.

Word DEMAS as an indicator word which also uses the same convention as the word DEMIND. When a car has been assigned to answer a demand, a bit is set in DEMAS corresponding to the demand bit in DEMIND. The bit is reset in DEMAS when the car responds and the call is reset.

Figure 6:
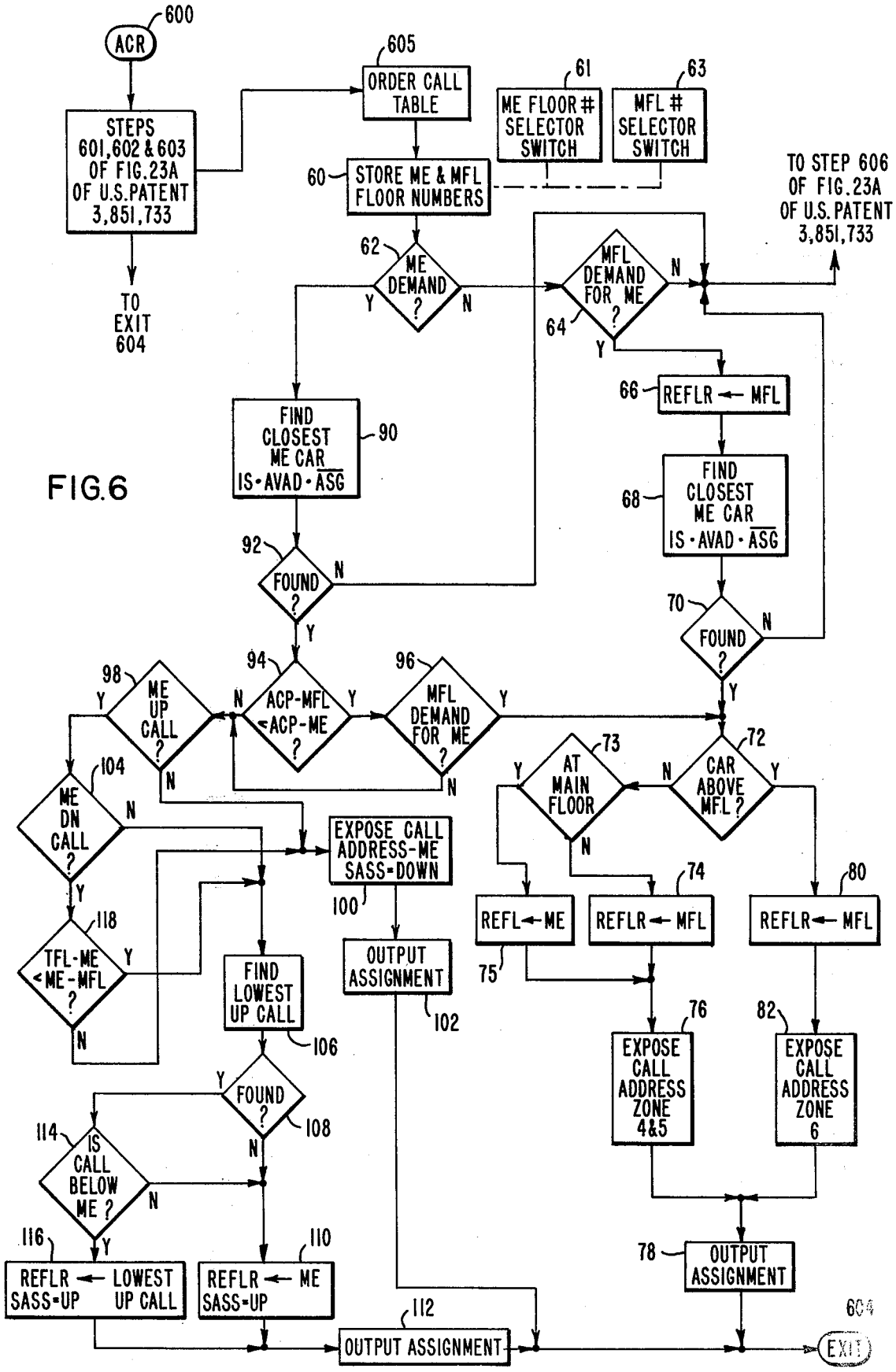
FIG. 6 is a flow chart illustrating the programming of a programmable system processor to obtain new and improved elevator operating strategies taught by the invention.

FIG. 6 is a flow chart which illustrates how program ACR shown in FIG. 23A of the incorporated U.S. Pat. No. 3,851,733 would be modified to incorporate the teachings of the invention relative to a special floor or middle extension. The teachings of the invention are not limited to the specific strategies of the incorporated U.S. patent, and may easily be incorporated into any elevator system having a plurality of elevator cars under group control.

The modification of the program ACR may be placed at any point in the program, depending upon the level of priority to be placed upon obtaining an available car for demands associated with the special floor. If the special floor is special because it is served by less than the total number of elevator cars, the priority level should be quite high. Otherwise, the car (or cars) capable of serving the special floor may continually be assigned to higher priority demands when they become available, causing very poor service to be provided for the special floor when the elevator system is busy. The present invention permits a high priority to be placed on the special floor demands, with little adverse effect on overall elevator service to the building. A suitable point for insertion of the strategy according to the teachings of the invention is between steps 605 and 606 of program ACR shown in FIG. 23A of U.S. Pat. No. 3,851,733, thus giving a demand associated with the special floor priority over all system demands except a timed out demand for the main floor.

More specifically, program ACR is entered at terminal 600 when there is a system demand, indicated by a bit being set in the word DEMIND of FIG. 5. Program ACL of the incorporated patent sets the proper bit in the word DEMIND when it attempts to allocate a hall call to a suitably-conditioned busy car and it finds that the call cannot be so allocated. A further condition upon entering program ACR, in addition to there being at least one system demand, is the fact that there must be at least one car which is available for assignment (AVAS = 1 for at least one of the elevator cars). The noting of whether or not there is at least one available car in the system is provided by the car status update program CSU of the incorporated patent. Since the details of ACL and CSU are set forth in U.S. Pat. No. 3,851,733, and since these details are not an essential part of the present invention, they are not included in the present application.

More specifically, sub-program ACR starts at terminal 600 and goes through steps 601, 602, and 603 which are related to a demand for the main floor, i.e., floor No. 1 in the example. If there is an unsatisfied demand for the main floor, the program searches for an available car to assign to this demand. If a car cannot be found, the program may exit at terminal 604 since it is unlikely that a car could be located for any other type of demand which might be registered. Or, the program may be arranged to check certain other types of demands and attempt to find a car if it finds one of these demands registered. The complete program loop is so fast that there will usually only be one type of demand registered for any specific running of ACR. Thus, as a practical matter, when ACR finds a demand and it cannot assign a car to that demand, the program may immediately return to the priority executive which selects the next sub-program to be run.

If steps 601, 602, and 603 do not find an unsatisfied demand for the main floor, the program advances to step 605 which orders the registered hall call to place the highest hall call in the building at the top of the call table CL, and the remaining calls in order as they appear in the building when proceeding downwardly from the highest call registered.

The program then advances to step 60 which stores the floor number of the specific special or middle extension floor M.E. being considered as well as the floor number of the main floor. These floor numbers may be selected by selector switches 61 and 63, respectively. Step 62 then determines if a demand has been created by the registration of an up or down hall call at the special floor which could not be allocated to a busy car by program ACL. This may be determined by checking bit No. 3 of the demand word DEMIND shown in FIG. 5, when a single bit indicates either an up demand, a down demand, or both. This may be determined by checking both bits No. 3 and No. 1 when different bits are utilized for up and down M.E. demands. If there is no demand relative to a hall call at the special floor, step 64 checks to see if there is a demand at the main floor (floor No. 1) for the special floor. This demand would be created when program ACL is unable to allocate a call entered via the up pushbutton 52 shown in FIG. 1. Step 64 would check bit No. 10 of DEMIND to determine if there is a main floor demand for the special floor. If bit No. 10 of DEMIND is not set, the program would advance to step 606, and the remaining portion of the program would be that shown and described in U.S. Pat. No. 3,851,733.

If step 62 finds no demand created by a call at the special floor, but step 64 finds that there is a demand for the special floor which was placed at the main floor, step 66 makes the main floor the reference floor REFLR, and step 68 then searches for the closest car to this reference floor which meets all of the following tests:

(a) The car is capable of serving the special floor.
(b) The car is in service (INSC = 1).
(c) The car is available according to the system processor (AVAD = 1).
(d) The car is not assigned to a demand ($\overline{ASG}$ = 1).

Step 70 determines if such a car was found, and if such a car was not found, the program advances to step 606. The program is not exited at this point because there may be an available car which is not able to serve the special floor, but is capable of serving other demands.

If step 70 indicates a car was found which meets all of these tests, its car number is noted, and step 72 determines if the car found is above the main floor. If it is above the main floor, the reference floor REFLR is set with the address of the main floor in step 80 and the car is made a down-running car by exposing the call as a zone 6 call, and by giving the car the binary address of the main floor. Step 78 outputs the assignment to the selected car, by preparing signals FAD0-FAD6, the binary address of the next stop for the car, i.e., the main floor in this instance, the floor assignment mode signals MOD0 and MOD1, which are set to enable the car to only see a call at the specific floor address provided by signals FAD0-FAD6, the travel assignment TASS which sets the car to have a down travel direction, and the service assignment SASS which sets the car for up travel when it reaches the address floor. After the assignment is output to the selected car, the program exits at terminal 604.

If step 72 finds that the car which was found is not above the main floor, step 73 determines if the car is at the main floor. In the example of FIG. 1, the main floor is the lowest floor, so step 73 will find the car at the main floor and step 75 will set the reference floor to the special floor M.E. Step 76 exposes the binary address of the special floor and makes the car an up-running car by exposing zones 4 and 5. Step 78 outputs the assignment, which includes a command to open the doors (DOPN), the binary address FAD0-FAD6 of the special floor, travel and service direction assignments TASS and SASS, and the assignment mode bits MOD0 and MOD1.

If the building has one or more basement floors below the main floor, and step 73 finds the car is not at the main floor, it must be below the main floor. Step 74 makes the reference floor REFLR the main floor, step 76 provides the address of the main floor, and makes the car an up-running car by exposing zones 4 and 5. Step 78 outputs the assignment to the car and the program exits at terminal 604. When the car reaches the main floor, it will be given the assignment to travel to the special floor on a subsequent running of the program.

If step 62 finds a demand at the special floor, step 90 begins the search for the closest in-service car (INSC = 1), which is available according to the system processor (AVAD = 1), not assigned to a demand ($\overline{ASG}$ = 1), and which is capable of serving the special floor. If such a car is not found, step 92 advances to step 606 to check for other system demands.

If step 92 finds such a car, step 94 checks the position of the car found relative to the special floor and relative to the main floor. The main floor number is subtracted from the floor number of the advanced car position (ACP) and compared with the difference between the floor number of the special floor and the floor number of the advanced car position (ACP). If step 94 finds that the car found is closer to the main floor than it is to the special floor, step 96 checks bit No. 10 of DEMIND in FIG. 5 to see if there is a main floor demand for the special floor. If there is a main floor demand for the special floor, the program advances to step 72, hereinbefore described, to handle the main floor demand for the special floor, which will ultimately result in a car being sent to the special floor.

If step 96 finds that bit No. 10 of DEMIND is not set, of if step 94 finds that the car found is closer to the special floor then it is to the main floor, the program advances to step 98 which determines if there is an up hall call registered at the special floor. Step 98 may do this by checking bit No. 3 of DEMIND, or by checking the call record CLR in FIG. 4. If there is no up hall call registered, the call which triggered the demand must be a down hall call and step 100 exposes the address of the special floor. Step 102 prepares the assignment for the car found, and outputs the assignment to this car. The assignment will set the car for the proper travel direction (TASS) to travel to the special floor, it will give it a down service assignment (SASS) so it will handle the down call at the special floor, it will give it the binary address of the special floor in signals FAD0-FAD6, and it will set the mode bits MOD0-MOD1 to cause the car to travel directly to the special floor without answering intervening hall calls.

If step 98 finds an up hall call at the special floor, step 104 checks to see if a down hall call is also registered. Step 104 may do this by checking bit No. 0 of DEMIND in FIG. 5, or by checking the appropriate bit of the call record CLR in FIG. 4.

If step 104 finds no down hall call, step 106 checks to see if the car could conveniently answer an up hall call on its way to the special floor, by locating the lowest up call. Step 108 determines if an up hall call has been found. If there are no up hall calls, step 110 makes the reference floor REFLR the special floor, and the assignment is prepared and output to the car found in step 112.

If step 108 finds an up hall call, step 114 determines if the call found is below the special floor. If it is not, the program advances to steps 110 and 112 which assign the car found to the special floor. If step 114 finds that the hall call is located below the special floor, step 116 sets the reference floor REFLR to the floor number of the up call found. Step 112 prepares the assignment for the car such that it will travel to the floor of the up hall call. The up hall call at the special floor will then be answered in due course.

If step 104 finds there is a down hall call registered at the special floor, as well as an up hall call, step 118 adds significantly to the quality of elevator service by determining the position of the special floor in the building. If the special floor is located in the upper one-half of the building, the up hall call at the special floor is given priority. If the special floor is located in the lower one-half of the building, the down hall call at the special floor is given priority. Step 118 may determine the location of the special floor by subtracting the floor number of the special floor from the number of the top floor of the building, and then compare the resulting number with the difference between the floor number of the special floor and the number of the main floor (or the number of the bottom floor). If the special floor is in the upper one-half of the building, the program advances to step 106, in order to process the up hall call at the special floor as hereinbefore described. If the special floor is located in the lower one-half of the building, the program advances to step 100 in order to serve the down hall call at the special floor, as hereinbefore described.

In summary, there has been disclosed a new and improved elevator system, and method of operating an elevator system, in order to cause a plurality of elevator cars to efficiently serve a special floor located between the top and bottom floors of the building, from which both up and down hall calls may be registered. The special floor is given a high priority with little deleterious effect on the over-all quality of elevator service, by determining the position of the special floor in the building when up and down hall calls coexist from the special floor. If the special floor is located in the upper one-half of the building, the up hall call at the special floor is given priority over the down hall call. If the special floor is located in the lower one-half of the building, the down hall call is given priority over the up hall call.

I claim as my invention:

1. A method of providing elevator service for a special floor of a building, which special floor is located between the top and bottom floors, comprising the steps of:

providing means for registering up and down hall calls from the special floor, determining when registered up and down hall calls coexist from the special floor;

and giving a predetermined one of such coexisting hall calls priority over the other, according to the location of the special floor in the building, said step of giving priority to a predetermined one of coexisting hall calls at the special floor including the steps of giving the up hall call priority over the down hall call when the special floor is located in the upper one-half of the building, and giving the down hall call priority over the up hall call when the special floor is located in the lower one-half of the building.

2. A method of providing elevator service for a special floor of a building, which special floor is located between the top and bottom floors, comprising the steps of:

selecting the special floor to be any desired floor between the top and bottom floors of the building, determining the position of the selected special floor relative to the upper and lower halves of the building, providing means for registering up and down hall calls from the special floor, determining when registered up and down hall calls coexist from the special floor, and giving a predetermined one of such coexisting hall calls priority over the other, according to the location of the special floor in the building.

3. A method of providing elevator service for a special floor of a building, which special floor is located between the top and bottom floors, comprising the steps of:

providing means for registering up and down hall calls from the special floor, determining when registered up and down hall calls coexist from the special floor, giving a predetermined one of such coexisting hall calls priority over the other, according to the location of the special floor in the building, selecting a floor of a building as a main floor, providing means for registering a call for the special floor from the main floor, locating the closest in-service, available car capable of serving the special floor, determining if a call has been registered at the main floor for the special floor, determining if the car found is closer to the special floor than to the main floor, assigning the car found to the main floor call for the special floor when the car found is closer to the main floor than to the special floor, and assigning the car found to the special floor when the car found is closer to the special floor than to the main floor.

4. An elevator system, comprising:

a building having a plurality of floors, a plurality of elevator cars mounted for movement in said building, said building having a special floor located between the top and bottom floors, hall call registering means at said special floor for registering up and down hall calls, supervisory control means responsive to said hall call registering means, said supervisory control means assigning an elevator car capable of serving the special floor to a hall call registered from said special floor, said supervisory control means being responsive to the position of the special floor in the building when registered up and down hall calls coexist from said special floor, assigning an elevator car to serve a predetermined one of the coexisting hall calls before the other, according to the location of the special floor relative to the top and bottom floors of the building.

5. The elevator system of claim 4 wherein the supervisory control means includes means for determining whether the special floor is located in the lower one-half, or the upper one-half of the building, with the supervisory control means giving priority to the up hall call when up and down hall calls coexist from the special floor, when the special floor is in the upper one-half of the building, and priority to the coexisting down hall call when the special floor is in the lower one-half of the building.

6. The elevator system of claim 4 wherein the elevator cars are each enabled to serve certain of the floors of the building, with less than the total number of elevator cars being enabled to serve the special floor.

7. The elevator system of claim 4 including means for selecting the special floor to be any floor between the top and bottom floor of the building, and wherein the supervisory control means includes means for determining whether the selected position of the special floor is in the upper one-half, or the lower one-half of the building.

8. The elevator system of claim 4 wherein the supervisory control means includes means for determining when up and down hall calls coexist from the special floor, considering up and down hall calls from the special floor to be coexisting only when neither have had an elevator car assigned to serve the call.

9. The elevator system of claim 4 wherein the supervisory means includes means for locating the closest in-service, available car capable of serving the special floor, with said supervisory control means assigning this car, when found, to serve a call at the special floor.

10. The elevator system of claim 4 including means selecting a floor of the building as a main floor, and means for registering a call for the special floor from said main floor, and wherein the supervisory control means includes means responsive to a hall call from the special floor for locating the closest in-service, available car capable of serving the special floor, means determining the position of the car found relative to the special floor and to the main floor, means checking the main floor for a hall call for the special floor, wherein the supervisory control means, when hall calls coexist from the special floor, and for the special floor from the main floor, assigns the car found to serve the hall call registered at the closer of the two floors to the position of the car.

* * * * *